US007484346B2

(12) United States Patent
Baptista

(10) Patent No.: US 7,484,346 B2
(45) Date of Patent: Feb. 3, 2009

(54) VACUUM PACKAGING APPLIANCE WITH REMOVABLE TROUGH

(75) Inventor: Alexandre A. N. Baptista, Dublin, CA (US)

(73) Assignee: Sunbeam Products, Inc., Boca Raton, FL (US)

( * ) Notice: Subject to any disclaimer, the term of this patent is extended or adjusted under 35 U.S.C. 154(b) by 0 days.

(21) Appl. No.: 11/706,778

(22) Filed: Feb. 15, 2007
(Under 37 CFR 1.47)

(65) Prior Publication Data

US 2007/0193230 A1 Aug. 23, 2007

Related U.S. Application Data

(62) Division of application No. 10/789,451, filed on Feb. 26, 2004, now Pat. No. 7,204,067.

(60) Provisional application No. 60/450,528, filed on Feb. 27, 2003, provisional application No. 60/450,295, filed on Feb. 27, 2003.

(51) Int. Cl.
*B65B 31/04* (2006.01)

(52) U.S. Cl. ..... 53/512; 53/432; 53/510; 53/405; 53/434

(58) Field of Classification Search ..... 53/432, 53/433, 510, 511, 434, 52, 512, 405
See application file for complete search history.

(56) References Cited

U.S. PATENT DOCUMENTS

| | | | |
|---|---|---|---|
| 1,143,579 | A | 6/1915 | Denhard |
| 1,346,435 | A | 7/1920 | Worster |
| 1,521,203 | A | 12/1924 | Roehrig |
| 2,079,069 | A | 5/1937 | Johnson |
| 2,270,332 | A | 1/1942 | Osborn, Jr. |
| 2,270,469 | A | 1/1942 | Osborn, Jr. |
| 2,319,011 | A | 5/1943 | Meredith |
| 2,354,423 | A | 7/1944 | Rosenberger |
| 2,421,149 | A | 5/1947 | Hard et al. |

(Continued)

FOREIGN PATENT DOCUMENTS

| | | |
|---|---|---|
| EP | 0723915 A1 | 7/1996 |

(Continued)

OTHER PUBLICATIONS

U.S. Appl. No. 11/487,903, filed Jul. 17, 2006, Patterson et al.

(Continued)

*Primary Examiner*—Christopher Harmon
(74) *Attorney, Agent, or Firm*—Hoffmann & Baron, LLP

(57) ABSTRACT

An appliance for storing articles within flexible and non-flexible containers under vacuum. The appliance comprises a lid adapted to define a vacuum chamber when it is moved to a closed position relative to a trough in the base of the appliance. The trough is slidably removable from the base of the appliance. The appliance is further adapted for connection to vacuum sealing attachments for various containers whereby the containers can be selectively evacuated. The appliance includes a thermal sealing mechanism for sealing a flexible container as well as a cutting mechanism for cutting the flexible container to a desired size. The appliance includes a control panel for selectively operating the vacuuming and sealing processes.

14 Claims, 7 Drawing Sheets

U.S. PATENT DOCUMENTS 2,506,362 A 5/1950 Hofmann
2,568,226 A 9/1951 Drake
2,617,304 A 11/1952 Conover
2,672,268 A 3/1954 Bower
2,749,686 A 6/1956 Lorenz et al.
2,755,952 A 7/1956 Ringen
2,778,171 A 1/1957 Taunton
2,899,786 A 8/1959 Harker
2,963,838 A 12/1960 Harrison et al.
3,038,283 A 6/1962 Unger
3,055,536 A 9/1962 Dieny
3,064,358 A 11/1962 Guiffre
3,148,269 A 9/1964 Van Hartesveldt et al.
3,234,072 A 2/1966 Dreeben
3,320,097 A 5/1967 Sugalski
3,464,256 A 9/1969 Lloyd
3,516,223 A 6/1970 Andersen et al.
3,589,098 A 6/1971 Schainholz et al.
3,688,463 A 9/1972 Titchenal
3,699,742 A 10/1972 Giraudi
3,800,503 A 4/1974 Maki
3,832,824 A 9/1974 Burrell
3,858,750 A 1/1975 Grall
3,866,390 A 2/1975 Moreland, II et al.
3,928,938 A 12/1975 Burrell
3,962,847 A 6/1976 Trudel
3,965,646 A 6/1976 Hawkins
4,006,329 A 2/1977 Hellman et al.
4,008,601 A 2/1977 Woods
4,021,290 A 5/1977 Smith
4,059,113 A 11/1977 Beinsen et al.
4,105,491 A 8/1978 Haase et al.
4,143,787 A 3/1979 Walker
RE30,045 E 7/1979 Greene
4,164,111 A 8/1979 Di Bernardo
4,179,862 A 12/1979 Landolt
4,208,902 A 6/1980 Kim et al.
4,221,101 A 9/1980 Woods
4,222,276 A 9/1980 DeRogatis
4,330,975 A 5/1982 Kakiuchi
4,372,096 A 2/1983 Baum
4,471,599 A 9/1984 Mugnai
4,541,224 A 9/1985 Mugnai
4,545,177 A 10/1985 Day
4,549,387 A 10/1985 Marshall et al.
4,561,925 A 12/1985 Skerjanec et al.
4,578,928 A 4/1986 Andre et al.
4,581,764 A 4/1986 Plock et al.
4,583,347 A 4/1986 Nielsen
4,620,408 A 11/1986 Parnes
4,631,512 A 12/1986 Hishiki et al.
4,641,482 A 2/1987 Metz
4,756,140 A 7/1988 Gannon
4,860,523 A 8/1989 Teteishi et al.
4,909,014 A 3/1990 Kobayashi et al.
4,922,686 A 5/1990 Segota
4,928,829 A 5/1990 Di Bernardo
4,941,310 A 7/1990 Kristen
5,048,269 A 9/1991 Deni
5,056,292 A 10/1991 Natterer
5,177,937 A 1/1993 Alden
5,209,044 A 5/1993 D'Addario et al.
5,232,016 A 8/1993 Chun
5,239,808 A 8/1993 Wells et al.
5,352,323 A 10/1994 Chi
RE34,929 E 5/1995 Kristen
5,450,963 A 9/1995 Carson
5,461,901 A 10/1995 Ottestad
5,465,857 A 11/1995 Yang
5,515,773 A * 5/1996 Bullard ..... 99/330
5,544,752 A 8/1996 Cox
5,551,213 A 9/1996 Koelsch et al.
5,597,597 A * 1/1997 Newman ..... 426/248
5,608,167 A 3/1997 Hale et al.
5,617,893 A 4/1997 Webster
5,620,098 A 4/1997 Boos et al.
5,638,664 A 6/1997 Levsen et al.
5,655,357 A 8/1997 Kristen
5,682,727 A 11/1997 Harte et al.
D389,847 S 1/1998 Huang
5,712,553 A 1/1998 Hallberg
5,735,395 A 4/1998 Lo
5,765,608 A 6/1998 Kristen
5,784,857 A 7/1998 Ford et al.
5,784,862 A 7/1998 Germano
5,803,282 A 9/1998 Chen et al.
5,825,974 A 10/1998 Hutton
5,889,684 A 3/1999 Ben-David et al.
5,893,822 A 4/1999 Deni
5,954,196 A 9/1999 Lin
6,058,998 A 5/2000 Kristen
6,070,397 A 6/2000 Bachhuber
6,072,172 A 6/2000 Duggan et al.
6,085,906 A 7/2000 Lambert
6,124,558 A 9/2000 Baumeister et al.
6,161,716 A 12/2000 Oberhofer et al.
6,256,968 B1 7/2001 Kristen
6,328,897 B1 12/2001 Leung
6,467,242 B1 10/2002 Huang
6,481,180 B1 11/2002 Takahashi et al.
6,520,071 B1 2/2003 Lanza
6,619,493 B2 9/2003 Yang
6,694,710 B2 2/2004 Wang
6,789,690 B2 9/2004 Nieh et al.
6,792,736 B1 9/2004 Takahashi et al.
6,827,243 B1 12/2004 Nuzzolese
7,003,928 B2 * 2/2006 Patterson et al. ..... 53/405
7,200,974 B2 * 4/2007 Higer et al. ..... 53/86
7,207,160 B2 4/2007 Baptista
2003/0000180 A1 1/2003 Singer
2003/0103881 A1 6/2003 Lane et al.
2003/0140603 A1 7/2003 Krasenics, Jr. et al.
2003/0159405 A1 8/2003 Knowlton et al.
2004/0031245 A1 2/2004 Kingeter et al.
2004/0060262 A1 4/2004 Harges et al.
2005/0011166 A1 1/2005 Germano
2005/0022473 A1 2/2005 Small et al.
2005/0022474 A1 2/2005 Albritton et al.
2005/0028494 A1 2/2005 Higer et al.
2005/0039420 A1 2/2005 Albritton et al.
2005/0050856 A1 3/2005 Baptista
2005/0108990 A1 5/2005 Kahn et al.

FOREIGN PATENT DOCUMENTS

EP 0 723 915 B1 9/1999
EP 1053945 A1 11/2000
EP 1 149 768 A1 10/2001
EP 1 433 719 A1 6/2004
GB 2211161 A 6/1989
IT 1 278 835 11/1997
JP A-S62-287823 12/1987
JP U-S63-079307 5/1988
JP 63-307023 12/1988
JP 05-10211 2/1993
JP 2000-043818 2/2000
JP 2000-43818 2/2000
JP A-2002-308215 10/2002
WO WO 99/48758 9/1999
WO WO 00/71422 11/2000
WO WO00/71422 11/2000
WO WO 02/10017 A1 2/2002
WO WO 03/064261 A1 8/2003
WO WO 2004/048203 6/2004

WO WO 2004/065222 A1 8/2004

OTHER PUBLICATIONS

U.S. Appl. No. 11/593,581, filed Nov. 6, 2006, Kahn et al.
"Vacuum Seal-A-Meal Instructions and Recipe Book," by Dazey.
"Foodsaver, The First Commercial-Quality Vacuum Packaging System for the Home," Deanna DeLong, 1988.
"Foodsaver, The First Commercial-Quality Vacuum Packaging System for the Home," Deanna DeLong, 1987.
Magic Vac® Champion Commercial Quality Vacuum Sealer Model #1750, © 2000, Instruction Manuel, Deni, pp. 1-15.

* cited by examiner

VACUUM PACKAGING APPLIANCE WITH REMOVABLE TROUGH

CROSS-REFERENCE TO RELATED PATENT APPLICATIONS

The present application is a divisional of U.S. patent application Ser. No. 10/789,451 filed on Feb. 26, 2004 now U.S. Pat. No. 7,204,067, entitled "Vacuum Packaging Appliance with Removable Trough," which claims priority to U.S. provisional patent application 60/450,528 filed Feb. 27, 2003, entitled "Vacuum Packaging System with a Secondary Vacuum Latching Mechanism," and U.S. provisional patent application 60/450,295, entitled "Vacuum Packaging System with Removable Trough," filed Feb. 27, 2003. Each of the aforementioned applications are incorporated herein by reference.

FIELD OF THE INVENTION

The present invention relates to home vacuum packaging appliances. In particular, the present invention teaches a vacuum packaging appliance with a removable trough useful for capturing fluids and contaminants during container evacuation.

BACKGROUND OF THE INVENTION

Various appliances and methods are used for the purpose of vacuum packaging and sealing plastic bags and containers to protect perishables, such as foodstuffs, and other products against oxidation. Conventional commercial devices and some consumer appliances are generally expensive to manufacture, complex in construction and/or cumbersome to operate. One conventional type of vacuum sealing system, primarily used for commercial packaging purposes, includes a vacuum chamber in which the entire packaged product is placed, along with heat sealers and attendant components of the system.

Another type of conventional vacuum sealing system uses a vacuum nozzle that is inserted within a plastic bag for evacuation purposes. Although adaptable for low-volume home use, this type of system is cumbersome to use and normally requires a liquid separator or filter to prevent liquids or powders, retained within the bag, from being drawn into a vacuum pump connected to the nozzle. Further, the heat sealer employed therein must be closely calibrated and synchronized with the positioning and withdrawal of the vacuum nozzle from the bag.

Still another known vacuum sealing system places a portion of a bag, containing a product to be packaged, in a first vacuum chamber and extends an open end or neck of the bag into a second vacuum chamber. The first vacuum chamber is then evacuated to expand the neck of the bag to isolate the chambers from each other. Then a vacuum is drawn in the second vacuum chamber to evacuate the bag. Thus, isolation of the two chambers from each other, during evacuation of the second vacuum chamber, is dependent on the physical properties composing the neck of the bag (which is intended to form a static seal between the two chambers) and very close synchronization and calibration of the evacuation and sealing procedures and controls therefor. A vacuum sealing system of this type is disclosed in U.S. Pat. No. 3,928,938, for example.

U.S. Pat. No. 2,778,171 discloses another vacuum sealing system, which is not believed to have been commercialized. In particular, the open end of a plastic bag is placed between a pair of jaws or between a lower jaw and a flexible sheet to evacuate the bag that is then heat-sealed. An inner surface of the bag has protuberances that make point contact with an opposite surface of the bag to define air exhaust passages during evacuation of the bag. More recent successfully marketed appliances are described in U.S. Pat. No. 4,941,310, the complete contents of which is incorporated herein by reference.

During operation of the home vacuum packaging appliance, the primary intention is to evacuate any gas from the container in order to reach a certain vacuum level. During this vacuum process, fluids and other contaminants can also be evacuated from the container. To prevent these contaminants from entering, clogging and damaging the vacuum circuit, most present vacuum packaging appliances are built with a drip trough within their base. While this drip trough is useful, emptying and cleaning the drip trough can be somewhat troublesome. What is needed is a simple and more reliable mechanism whereby a user can maintain the drip trough in a clean and workable state.

SUMMARY OF INVENTION

The present invention teaches a variety of vacuum packaging appliances and removable troughs for use with vacuum packaging appliances.

Other features and advantages of the present invention will become apparent after reviewing the detailed description of the preferred and alternative embodiments set forth below.

DETAILED DESCRIPTION OF THE PRESENT INVENTION

Figure 1:
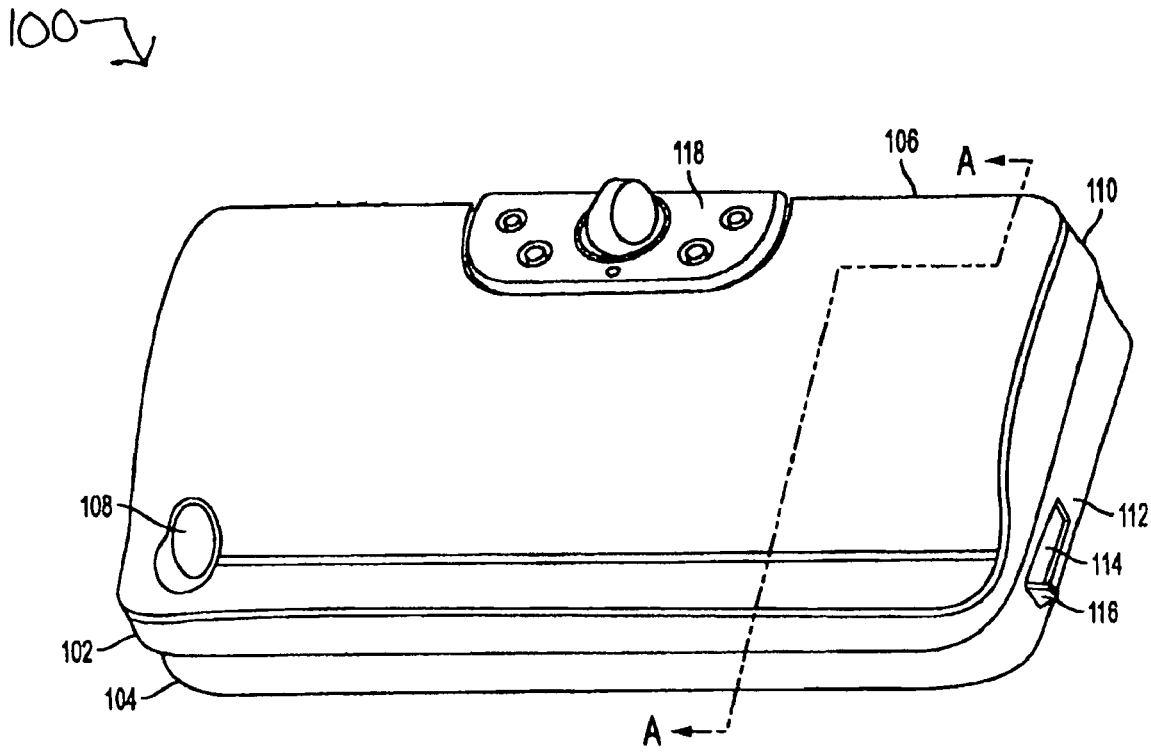
FIG. 1 is a perspective view of an embodiment of the vacuum packaging appliance of the invention.

One aspect of the present invention is directed to an appliance for packaging a container which comprises a first component, and a removable trough which is slidably coupled to the first component. The appliance also includes a second component that is operatively coupled to the first component and is moveable between a first position and a second position. The second component has an evacuation chamber that is configured to form a vacuum chamber with the trough when the second component is in the second position. The vacuum chamber is adapted to receive an open end of a container. The appliance includes a vacuum source that is coupled to the evacuation chamber and is configured to evacuate the container for a first desired amount of time.

Another aspect of the present invention is directed to an appliance for vacuum packaging a container which comprises a base that has a trough bay; a lid that is coupled to the base which is and moveable between an open position and a closed position; and a removable trough that is slidably coupled to the trough bay. The appliance also includes an evacuation chamber that is positioned in the lid and is configured to form a vacuum chamber with the trough when the lid is in the closed position. The vacuum chamber is adapted to receive an open end of the container therein. The appliance includes a vacuum source that is coupled to the evacuation chamber and is configured to remove air from the container for a desired amount of time.

Another aspect of the invention is directed to an appliance for evacuating a container that comprises a base that has an aperture in a side surface, and a trough that is removably coupled to the base through the aperture. The appliance includes a lid that is operatively associated with the base, wherein the lid and the trough define a vacuum chamber there between to receive an open end of the container. The appliance includes a vacuum source that is coupled to the vacuum chamber, whereby the vacuum source selectively evacuates the vacuum chamber.

In yet another aspect of the invention, an appliance for vacuuming air in a container comprising a lid moveable between an open position and a closed position. The appliance includes a base coupled to the lid which has a trough bay adapted to receive a removable trough. The appliance includes an evacuation chamber that is coupled to an inner surface of the lid and configured to form a vacuum chamber with the received trough in the closed position. The vacuum chamber is adapted to receive an open end of the container therein. The appliance includes a vacuum source that is coupled to the evacuation chamber and configured to remove air from the container.

In the above embodiments, the base and the lid are configured to form a substantially hermetic chamber within when in the second or closed position. The appliance further comprises a power source that is coupled to the vacuum source, whereby the power source is an AC and/or DC power source. The appliance further comprises a sealing mechanism for thermally sealing the container for a selected amount of time. The appliance further comprises a gasket coupled to a perimeter of the trough and/or the evacuation chamber such that the gasket is positioned between the trough and the evacuation chamber in the closed position. The trough port or aperture further comprises a slidable door that has a handle. The lid further comprises a device for cutting the container at a desired location along a dimension of the container, whereby the device further comprises: an area which defines a slot along an outer surface of the lid; a handle located on the outer surface and slidable along the slot; and a blade operatively coupled to the handle and located on an inner surface of the lid. The appliance further comprises a control panel coupled to the power source, whereby the control panel is configured to operate the vacuum source and/or the sealing mechanism at a desired setting. The appliance further comprises an accessory port that is coupled to the vacuum source, whereby the accessory port is adapted to removably engage a vacuuming attachment. The appliance further comprises an activation switch that is coupled to the power source, whereby the activation switch is configured to activate the appliance when in the closed position. The base further comprises a recess that is configured to house the container within the device.

Figure 4:
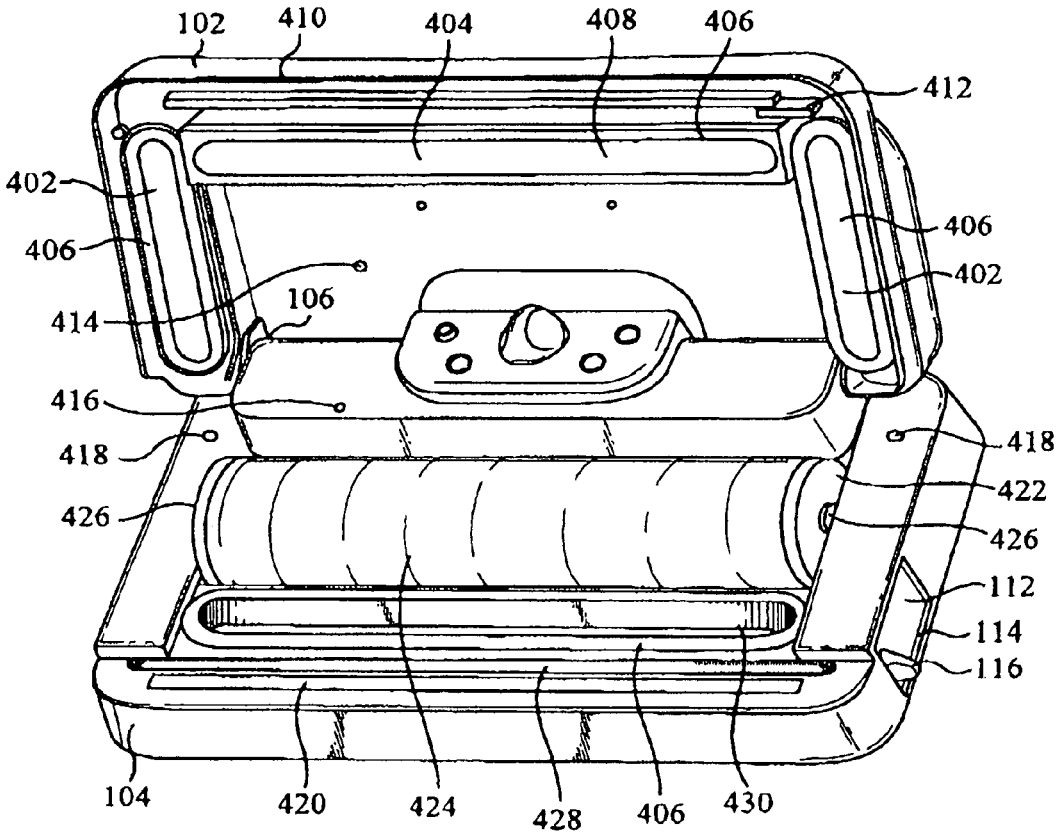
FIG. 4 is a perspective view of the appliance shown in FIG. 1 with the lid in an open position.

FIG. 1 shows a preferred embodiment of the appliance 100 for vacuum packaging containers in accordance with the present invention. The appliance 100 has a lid 102 and a base 104. In the embodiment shown in FIG. 1, the lid 102 and base 104 are preferably pivotally connected at a point 106 (FIG. 4). The lid 102 is pivotally movable between a closed position, as shown in FIG. 1, and an open position as shown in FIG. 4. It is preferred that the overall dimensions of the lid 102 are slightly larger than the overall dimensions of the base 104, such that the lid 102 fits over the base 104 when in the closed position, as shown in FIG. 1. Alternatively, the overall dimensions of the base 104 are larger or substantially the same size as the lid 102. Alternatively, the lid 102 and the base 104 are coupled to one another by any other convenient manner or are independent parts that are detachable from one another. The lid 102 and base 104 of the appliance 100 is preferably made of a durable material, including but not limited to plastic.

In the embodiment shown in FIG. 1, the lid 102 preferably includes a cutting mechanism for cutting sections of flexible bag material to be vacuum sealed, as is discussed below in detail. The cutting mechanism includes a blade handle 108 preferably located on the top surface of the lid 102. The blade handle 108 is associated with a blade 412 (FIG. 4) configured on the inside surface of the lid 102. The blade handle 108 is preferably slidably engaged within a slot 110 that extends substantially the entire length of the lid 102. The cutting mechanism alternatively has any other appropriate configuration to cut or sever the flexible bag material. In another alternative embodiment, the device does not have a cutting mechanism in accordance with the present invention.

Figure 5:
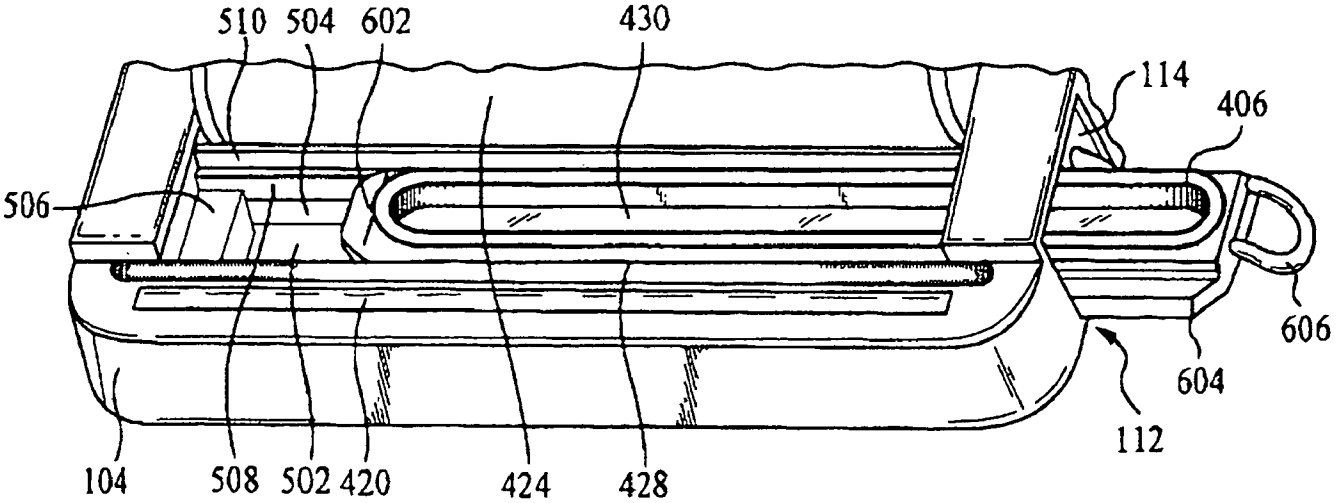
FIG. 5 is a perspective view of the trough bay with the trough partially removed therefrom.

The present appliance 100 preferably includes a trough port located on the side of the base 104. The trough port includes an aperture 112 that is associated with a trough bay 504 (FIG. 5). The aperture 112 has appropriate dimensions and is configured for removal of the trough 430 therethrough, as will be discussed below. The trough port preferably includes a door 114 slidably coupled to the interior of the base 104 and includes a protrusion or handle 116 that allows the user to easily slide the door 114 between an open and a closed position. The door 114 is in the closed position in FIG. 1 and in the open position in FIG. 5. Although the trough port is shown as rectangular, the trough port alternatively has any appropriate shape. Alternatively, the trough port is located on any appropriate surface of the device 100 associated with the trough bay 504, such as the side of the lid 102. It is also apparent to one skilled in the art that the trough port is alternatively not included in the present device 100.

The appliance 100 shown in FIG. 1 preferably includes a control panel 118 that is coupled with the base 104 and extends above the lid 102. The control panel 118 is alternatively located at elsewhere on the appliance 100. In another alternative embodiment, the present appliance 100 does not include a control panel. More details regarding the control panel 118 are described below.

Figure 2:
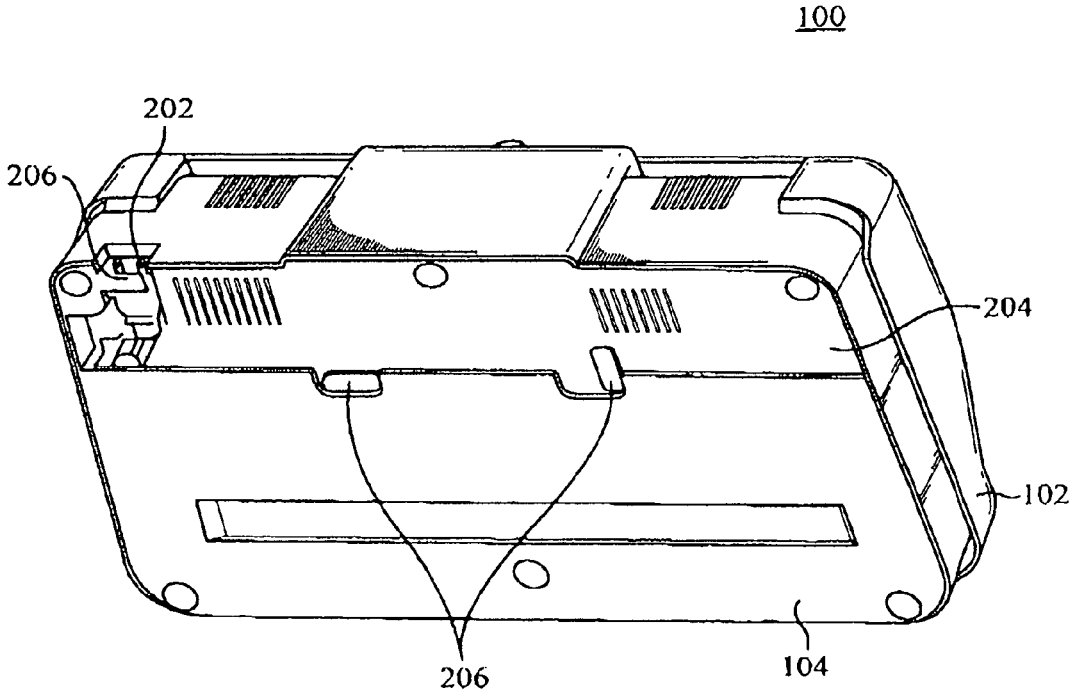
FIG. 2 is a perspective view of the underside of the appliance shown in FIG 1.

FIG. 2 illustrates a perspective view of the underside of the appliance 100. As shown in FIG. 2, the appliance 100 preferably includes an alternating current (AC) power cord 202 that is coupled with the base 104. In an alternate embodiment, the device 100 is powered by any convenient battery which provides direct current (DC) or various other known energy transfer technologies. In the preferred embodiment shown in FIG. 2, the base 104 also includes a battery compartment 204 or power cord 202 storage compartment. The base also includes one or more cord retention flanges 206. In the embodiment shown in FIG. 2, two of the cord retention flanges 206 are rotatably coupled to the base 104 and one cord retention flange 206 is fixed relative to the base 104. The rotatable cord retention flanges 206 allow the user to easily store the power cord 202 in the recess bay 204 when not using batteries with the present device 100. Alternatively, any or all of the cord retention flanges 206 are all fixed or rotatable. In another alternate embodiment, the recess bay 204 is of any convenient shape. Alternatively, the device 100 does not include a recess bay 204 nor flanges 206.

Figure 3:
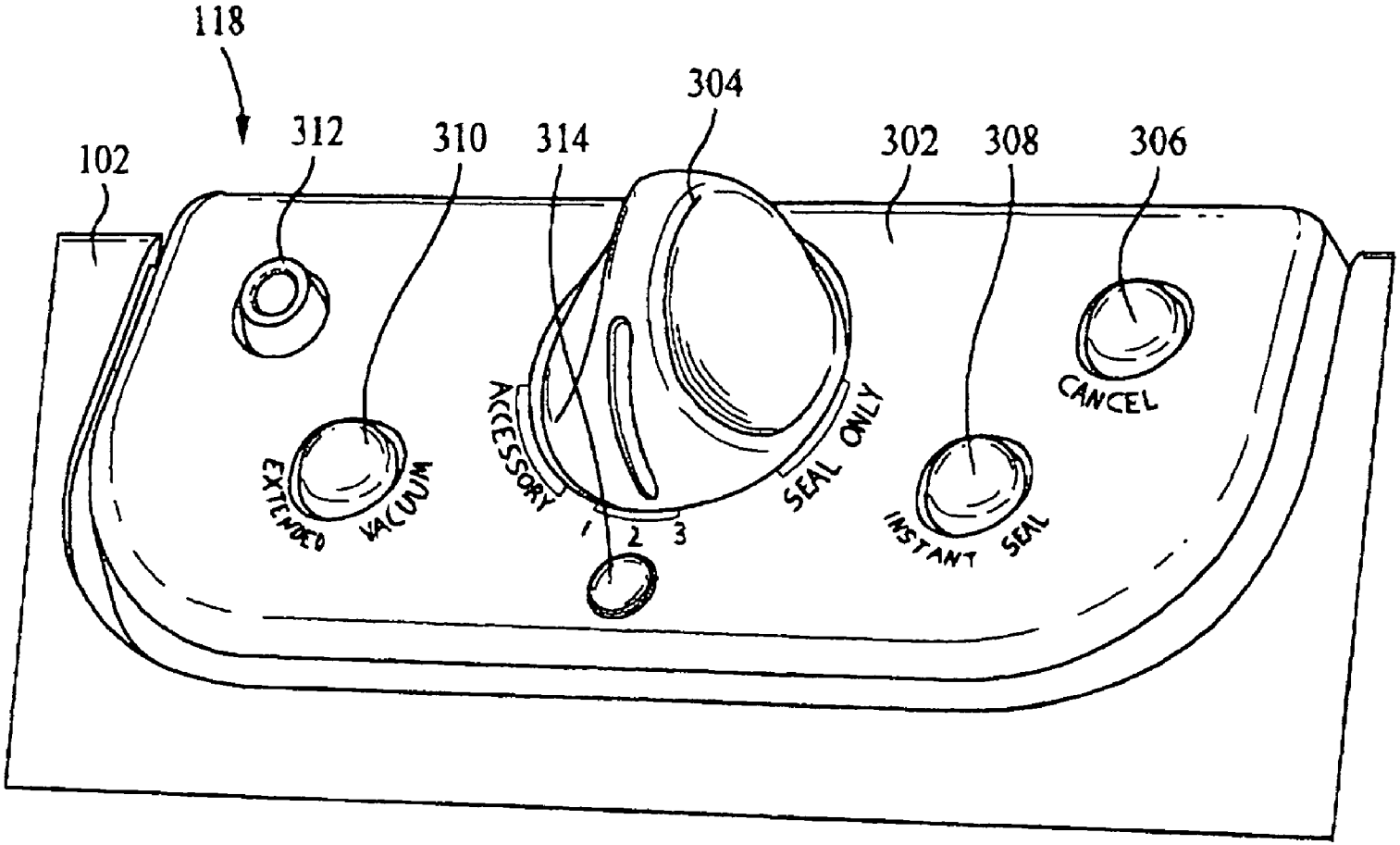
FIG. 3 is a perspective view of the control panel of the appliance shown in FIG. 1

FIG. 3 is a magnified view of the control panel 118 shown in FIG. 1. The control panel 118 has a face plate 302 that is preferably removably coupled to the device 100. The faceplate 302 is removable to facilitate cleaning of the appliance 100. In addition, the faceplate 302 is removable such that the appliance 100 may be manufactured with various faceplates that can accommodate a greater or fewer number of controls. Although the embodiment in FIG. 3 is shown with a removable faceplate 302, the faceplate 302 is alternatively fixed or integral to the base 104 or any other portion of the appliance 100. Alternatively, the control panel 118 is located elsewhere on the device 100.

The control panel 118 is electrically coupled to one or more vacuum sources (not shown) as well as the sealing mechanism 420 of the device 100, whereby operation of the vacuum source (not shown) and/or sealing mechanism 420 is controlled at the control panel 118. The vacuum source or sources (hereinafter vacuum source) is contained in any convenient location within the appliance 100. Alternatively, the vacuum source (not shown) is located external to the appliance 100. Preferably, the vacuum source is a piston type vacuum. Alternatively, the vacuum source is any other appropriate mechanism capable of drawing a vacuum.

In the embodiment shown in FIG. 3, the control panel 118 preferably includes a rotary dial control 304, a cancel control 306, an instant seal control 308, an extended vacuum control 310, an accessory port 312 and an indicator light 314. Alternatively, various other controls are included in the control panel 118 and/or various controls are excluded from the control panel 118. It is contemplated by one skilled in the art that the control panel 118 is alternatively a digital interface comprising a digital readout and/or buttons in conformity with the operation of the control panel 118.

In the embodiment shown in FIG. 3, the rotary dial 304 of the control panel 118 has multiple positions that control various aspects of the appliance 100. In particular, the rotary dial 304 is shown to have five positions labeled, "Accessory," "1", "2", "3" and "Seal Only". The rotary dial 304 shown in FIG. 3 is pointed to the position "2" setting. In an alternate embodiment, the rotary dial 304 has fewer or more settings that control the various aspects of the appliance 100.

When the rotary dial 304 is in the "Accessory" position, the accessory vacuum port 312 is activated. The accessory vacuum port 312 allows the user to utilize the present device 100 to externally vacuum package containers, as described in U.S. Pat. No. 4,491,310, by Hanns J. Kristen, issued Jul. 17, 1990, and assigned to the same assignee as this patent, the complete contents of which are incorporated herein by reference. The accessory vacuum port 312 is coupled to the one or more vacuum sources (not shown). An external vacuuming accessory (not shown) is removably coupled to the port 312 either directly or via a vacuum hose (not shown), whereby the device 100 is able to apply a vacuum to an item externally. When the rotary dial 304 is in any position other than the "Accessory" position, the accessory vacuum port 312 does not operate and vacuum is not drawn through the accessory vacuum port 312. Sealing off of the accessory vacuum port 312 is accomplished by any appropriate method and/or mechanism.

As stated above, the control panel 118 is coupled to the thermal sealing mechanism 420 (FIG. 4), whereby settings "1", "2" and "3" associated with the rotary dial 304 control the length of time that the vacuum source (not shown) as well as the sealing mechanism 420 (FIG. 4) operates in during the packaging procedure. It is preferred that the vacuum source performs the vacuuming process or mode before the sealing mechanism 420 initiates the sealing process or mode. Alternatively, the sealing mechanism 420 begins the sealing process as the vacuum source (not shown) finishes the vacuuming process. Alternatively, the sealing process and the vacuuming process occurs simultaneously.

In position "1", the vacuum source (not shown) and the sealing mechanism 420 (FIG. 4) operate for a first predetermined period of time, whereas position "2" activates the vacuum source (not shown) and the sealing mechanism 420 (FIG. 4) for a second predetermined period of time. Similarly, position "3" activates the vacuum source (not shown) and the sealing mechanism 420 (FIG. 4) for a third predetermined period of time. Thus, the user selects the duration of the vacuuming and sealing process by turning the knob 304 to the desired setting. In the preferred embodiment, the predetermined time period is longer for position "2" than position "1," whereas the time period is longer for position "3" than positions "1" and "2" and so on. Alternatively, the times associated with the various positions are in reverse order. Although the time periods are preferably predetermined and set by the manufacturer, it is contemplated that the time periods are alternatively set by the user and are fully customizable. Alternatively, the rotary dial 308 pointed to the "1", "2", or "3" position activates only the vacuum source (not shown) or the scaling mechanism 420. It is preferred that a timer circuit (not shown) within the device 100 controls the amount of time that the device 100 operates in its respective setting. It is apparent to one skilled in the art that the device 100 alternatively measures how much air is being drawn from the container 424 to determine whether to terminate the vacuuming process instead of using a timer.

Alternatively, a "Cut Only" position is associated with the rotary dial 304 which allows the user to close the lid 102 and activate the electro-mechanical switch without operating the vacuum source (not shown) nor the sealing mechanism 420. The "Cut Only" positions thereby allows the user to cut custom sized containers 424 from the container material roll 424.

The "Seal Only" position operates the sealing mechanism 420 (FIG. 4) only and does not operate the vacuum source (not shown). It is contemplated that the "Seal Only" setting operates the sealing mechanism 420 (FIG. 4) continuously for an indefinite amount of time. Alternatively, to prevent overheating of the scaling mechanism 420 (FIG. 4), the device 100 is equipped with a safety timer which automatically shuts off the sealing mechanism 420 (FIG. 4) after a predetermined amount of extended operating time in the case that the user inadvertently leaves the dial 304 on the "Seal Only" setting.

As shown in FIG. 3, the control panel 118 preferably includes a cancel button 306 which is electrically coupled to the vacuum source (not shown) and/or sealing mechanism 420 (FIG. 4). The cancel button 306 allows the user to cancel a vacuum operation and/or sealing operation at any time during the operation. In the embodiment shown in FIG. 3, the cancel button 306 is an electromechanical press-type switch. Alternatively, the cancel button 306 is any type of user-activated control mechanism. In an alternative embodiment, the appliance 100 does not include a cancel button 306.

In addition, the control panel 118 includes an instant seal button 308 which is electrically coupled to the vacuum source (not shown) and/or sealing mechanism 420 (FIG. 4). The instant seal button 308 allows the user to terminate the evacuation process and begin the sealing process when the instant seal button 308 is depressed. By way of example, the user may desire to only partially evacuate a container or not evacuate a container at all. Thus the user places the container in the device 100 and seals the container either without drawing the air out of the container or while partially drawing air out of the container and before the device begins to seal the container. FIG. 3 depicts the instant seal button 308 as an electro-mechanical press-type switch. Alternatively, the instant seal button 308 is any another appropriate mechanism. Alternatively, appliance 100 does not include an instant seal button 308.

The control panel 118 also preferably includes an extended vacuum button 310 which is electrically coupled to the vacuum source (not shown) and/or sealing mechanism 420 (FIG. 4). In the preferred embodiment, the extended vacuum button 310 extends the length of time of the evacuation or vacuuming process, preferably as long as the button 310 is depressed. In an alternative embodiment, the user depresses the extended vacuum button 310 during the evacuation process, whereby the appliance will continue the evacuation process for an additional predetermined amount of time after the first predetermined vacuum time is reached. In an alternative embodiment, the user depresses the extended vacuum button 310 during the evacuation process, whereby the container 424 will continue to be evacuated until the second predetermined time is reached. In another alternative embodiment, the user depresses the extended vacuum button 310 during the evacuation process, whereby the container will continue to be evacuated until the third predetermined time has been reached. Although FIG. 3 depicts the extended vacuum button 310 as a press-type electro-mechanical switch, in an alternate embodiment, the extended vacuum button 310 is any appropriate control mechanism. Alternatively, the appliance 100 does not include an extended vacuum button 310.

The control panel 118 shown in FIG. 3 also preferably includes an indicator light 314. The indicator light 314 notifies the user of the status of the appliance 100. In the preferred embodiment, the indicator light 314 is off when the device 100 is inactive. The indicator light 314 is preferably solid green while the device 100 is actively evacuating a container and emits intermittent green flashes when the device 100 is sealing a container (not shown). Alternatively, the light 314 emits various other colors, intensities and/or intervals to indicate various operations that the device 100 is performing. For example, the indicator light 314 alternatively flashes amber or some other color to indicate that the device 100 is currently drawing an extended vacuum. In an alternative embodiment, the indicator light 314 emits red to indicate that the accessory port 312 is active. In another alternative embodiment, the control panel 118 does not include an indicator light 314.

FIG. 4 illustrates a perspective view of the appliance 100 with the lid 102 in the open position. In the embodiment shown in FIG. 4, the lid 102 also includes a sealing gasket 410, a primary evacuation chamber 404, two side latch chambers 402, and the cutting mechanism 412. The appliance 100 preferably includes an activation switch that activates the device 100 only when the lid 102 is pressed down against the base 104. The activation switch includes a protrusion switch 414 and a electro-mechanical switch 416. The base 104 of the appliance 100 shown in FIG. 4 includes a set of evacuation apertures 418 and a thermal sealing mechanism 420.

The electro-mechanical switch 416 is electrically coupled to the control panel as well as the vacuum source (not shown), power source, and thermal sealing mechanism 420. The electro mechanical switch 416 is preferably disposed on the base 104 and located such that the switch 416 registers with the protrusion switch 414 when the lid 102 is in the closed position. Thus, when the lid 102 is in the closed position, the protrusion 414 comes into contact with the electro-mechanical switch 416 and actuates the switch 416 to activate the appliance 100. Preferably, the switch activates the power source (not shown) whereby the power source activates the vacuum source and/or the sealing mechanism. In an alternative embodiment, the electro-mechanical switch 416 and protrusion 414 are located elsewhere on the device 100. It is apparent to one skilled in the art that any other type of activation switch is alternatively utilized with the present invention. Alternatively, the present device does not include an activation switch.

The base 104 of the appliance 100 shown in FIG. 4 has a compartment 422 that is adapted to hold the container material 424. In the preferred embodiment, the container material 424 is a roll of flattened, tubular container material and is supported in the compartment 422 by rotational supports 426. The rotational supports 426 are designed to engage the ends of the roll of container material 424 and rotate freely within the compartment 422. In the preferred embodiment, each rotational support 426 has grooves at its perimeter to facilitate rotation of the container material 424. In an alternative embodiment, the appliance 100 does not include a compartment 422 for a roll of container material 424. Alternatively, the container material 424 is configured on a central spindle (not shown) which is coupled to the device 100 using any other convenient mechanism. In another alternative embodiment, the container material 424 is simply stored in the compartment 422 without any support mechanism.

In the preferred embodiment shown in FIG. 4, the roll of container material 424 is a single roll of continuously bonded plastic as described in U.S. Pat. No. RE34,929, by Hanns J. Kristen, issued May 9, 1995 a reissue patent based on U.S. Pat. No. 4,756,422, by Hanns J. Kristen, issued Jul. 12, 1988, assigned to the assignee of the present application, the complete contents of which are incorporated herein by reference. However, in alternate embodiments, the roll of container material 424 is any other appropriate material and/or has any other appropriate configuration.

As shown in FIG. 4, the base 104 also preferably includes a groove 428 which receives the blade of the cutting mechanism 412, whereby the groove is preferably located between the thermal sealing mechanism 420 and the trough bay 504 (FIG. 5). The groove 428 is positioned in the base 104 such that when the lid 102 is in the closed position, the cutting mechanism or blade 412 is substantially vertically aligned with the groove 428. In operation, the user moves the handle 108 (FIG. 1) along the slot 110 which causes the cutting mechanism 412 to travel along the groove 428. If container material 424 is placed between the blade (not shown) and the groove 428, the container material 424 will be cut by the blade (not shown) as the cutting mechanism traverses along the groove 428.

The cutting mechanism 412 is preferably a safety cutting mechanism designed to reduce the risk of injury to the user. In one embodiment, the blade 412 is removable from the cutting mechanism 412. In another embodiment, the blade 412 is permanently mounted to the cutting mechanism 412. The cutting mechanism 412 is an alternatively any other appropriate type of cutting mechanism. In an alternative embodiment, the cutting mechanism 412 has any other appropriate configuration to cut the container material. Alternatively, the device 100 does not include a cutting assembly 412.

The thermal sealing mechanism 420 preferably includes one or more electrically conductive wires (not shown) that produce heat when a voltage differential is applied across the length of the wire. The sealing mechanism 420 is preferably coupled to the control panel 118 and the power source. In the preferred embodiment, the electrically conductive wires (not shown) are covered with a Teflon tape. Alternatively, the wires are exposed or wrapped in any other appropriate material. When the lid 102 is in the closed position, the sealing gasket 410 presses against the sealing mechanism 420. This is referred herein as the sealing point. When the sealing mechanism 420 is activated and the container material 424 is disposed between the sealing gasket 410 and the sealing mechanism 420, the sealing mechanism heats and preferably melts the flexible container material 424 at the sealing point. Thus, the sealing mechanism 420 hermetically seals the container material 424 to allow the device 100 to optionally draw the air out from the container material 424 during the vacuum sequence. Although the sealing mechanism 420 is shown integrated with the appliance 100, alternatively, the sealing mechanism 420 is an external appliance. In an alternative embodiment, various other sealing mechanisms 420 are used to seal the container material 424, including, but not limited to, crimping or external clamps.

In the embodiment shown in FIG. 4, the appliance 100 includes a secondary evacuation chamber or chamber sealing mechanism which includes two pneumatic latch chambers 402 that are disposed on the underside of the lid 102. The secondary evacuation chamber serves to create a substantially hermetic environment within the device 100 when the device 100 is in the closed position. As shown in FIG. 4, the latch chambers 402 are elongated and have a concave cross-sectional shape, whereby the open end of the chambers 402 faces the base 104. Each latch chamber 402 also includes a flexible gasket 406 mounted on its outer perimeter rim, whereby the gasket 406 is configured to come into contact with the top surface 408 of the base 104 when the lid 102 is in the closed position.

The appliance 100 also includes one or more evacuation apertures 418, disposed in the base 104 at locations 432 such that the evacuation apertures 418 are registered with the latch chambers 402 when the lid 102 is in the closed position. The evacuation apertures 418 are coupled to the vacuum source (not shown) within the device 100, whereby the vacuum source (not shown) draws a vacuum via the evacuation apertures 418. The evacuation apertures 418 thereby withdraw the air contained within the concave latch chambers 402. The evacuation of the air from the latch chambers 402 further draws the lid 102 down towards the base 104 and creates a substantially hermetically sealed environment within the device 100. The gaskets 406 assist in securing the sealed environment within the device 100 by maintaining the vacuum within the latch chambers 402. It should be noted that fewer or more than two latch chambers 402 are alternatively contemplated in the present device. In an alternative embodiment, the latch chambers 402 are positioned at other locations in the device 100. In another alternative embodiment, the latch chambers 402 have any other appropriate cross-sectional shape. Alternatively, the evacuation apertures 418 are located within the latch chambers 402. Alternatively, the gaskets 406 are made of any other appropriate material to secure the seal within the device. It should be noted that the device 100 alternatively does not include a chamber sealing mechanism.

In addition, as shown in FIG. 4, the device 100 preferably includes a primary evacuation chamber 404 located along the lid 102 near the front of the base 104. The primary evacuation chamber 404 preferably has an elongated concave cross-sectional shape, whereby the open end of the chamber 404 is configured to face the base 104 and register with the opening of the trough 430 when the lid 102 is in the closed position. The primary evacuation chamber 404 also preferably includes a flexible gasket 406 mounted on its outer perimeter rim, whereby the gasket 406 is configured to come into contact with the gasket 406 disposed on the outer perimeter rim of the trough 430. Additionally, the primary evacuation chamber 404 preferably includes an evacuation port 408 within which is coupled to the vacuum source (not shown), whereby the vacuum source (not shown) draws a vacuum via the evacuation port 408. The primary evacuation chamber 404 and the trough 430 together form a hermetically sealed vacuum chamber when the lid 102 is closed and the device 100 is activated to perform the vacuum sequence. The open end of the flexible container material 424 is placed within the vacuuming chamber. Air is then drawn from the vacuum chamber through port 408 and removes the air within the container material 424, thereby vacuum packaging the container 424. It should be noted that alternatively more than one primary evacuation chamber 404 is contemplated within the present device. In an alternative embodiment, the primary evacuation chamber 404 is positioned at another location in the device 100. In another alternative embodiment, the primary evacuation chamber 404 has any other appropriate cross-sectional shape. Alternatively, the evacuation port 408 is located elsewhere in the device 100.

The gaskets 406 disposed on the perimeters of the primary evacuation chamber 404 and the trough 430 maintain the sealed environment between the chamber 404 and trough 430. The gaskets 406 are preferably removable from the evacuation chamber 404, latch chambers 402 and trough 430 for cleaning purposes. Alternatively, the gaskets 406 are not removable. Preferably, the gaskets 406 are made of rubber or any other flexible material. Alternatively, the gaskets 406 are made of any other appropriate material to secure a sealed environment within the device 100.

Figure 6:
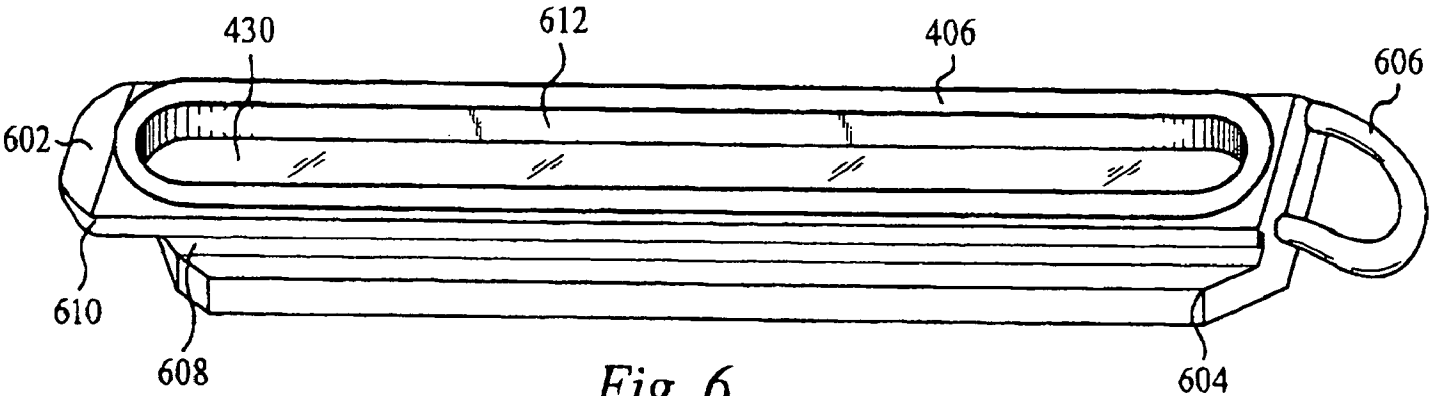
FIG. 6 is a perspective view of the trough in accordance with the present invention.

As shown in FIG. 4, the device 100 preferably includes the removable trough 430. FIG. 5 illustrates a detailed perspective view of the trough 430 partially removed from the trough bay 502 of the present device 100. FIG. 6 is a perspective view of the trough 430. The trough 430 is removable from the base 104 preferably through the aperture 112 located on the side of the base 104. Preferably, the door 114 is manually slidable between an open and a closed position. However, in an alternative embodiment, the door 114 is mechanically operated. In another alternative embodiment, the device 100 does not include the door 114. Although the trough 430 is shown disposed on the base 104, it is contemplated that the trough 430 and trough bay 502 are alternatively configured in the lid 102.

Figure 7:
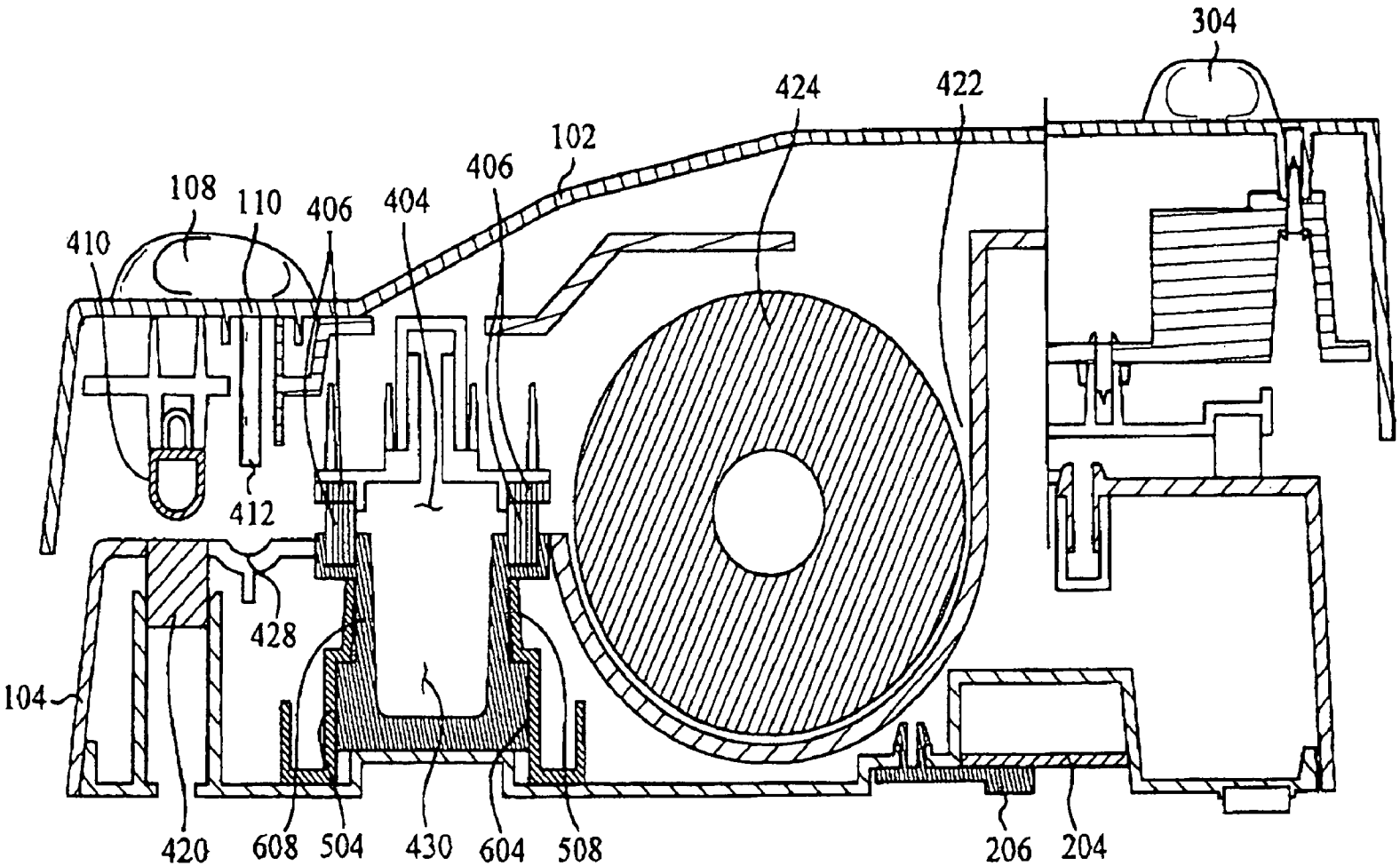
FIG. 7 is a cross-sectional view of the device shown in FIG. 1 along line A-A.

As shown in FIGS. 6 and 7, the trough 430 is preferably elongated and has a concave cross sectional shape. The open end 612 of the trough 430 preferably faces upward toward the primary evacuation chamber 408 when the lid 102 is closed as shown in FIG. 7. The trough 430 preferably includes a top portion 610 which also includes a groove (not shown) designed to allow the gasket 406 to be seated thereon. The top portion 610 is preferably designed to engage the corresponding indentation 510 located on the side surfaces of the trough bay 502. The trough 430 preferably includes flanges 608 along its sides that are designed to engage the corresponding protrusions 508 in the trough bay 502. In addition, as shown in FIGS. 5-7, the trough 430 preferably includes a bottom portion 604 that is designed to correspond with a bottom recess 504 in the bay 502. The trough 430 also preferably includes a handle 606, whereby the user is able to use the handle 606 to slidably insert and remove the trough 430 from the bay 502. Although the embodiment shown in FIG. 6 depicts the handle 603 as an open type loop, any convenient handle shape is alternatively used. Alternatively, embodiments, the trough 430 does not include a handle.

In the embodiment shown in FIG. 5, the trough bay 502 preferably has a length and width which corresponds to the length and width of the trough 430 such that liquid and/or food particles are not able to enter the trough bay 502. In addition, the top of the trough 430 preferably sits flush with the top surface of the bay 502 when coupled thereto. As shown in FIGS. 5 and 7, the retention flanges 504 along the sides of the bay 502 are designed to prevent substantial vertical and rotational movement of the trough 430 when the trough 420 is positioned in the bay 502. Although the embodiment shown in FIG. 5 includes retention flanges 504, the bay 502 is alternatively configured using any other appropriate mechanism to restrict movement of the trough 430 when positioned in the bay 502. Alternatively, the bay 502 does not have a mechanism for restraining vertical and/or rotational movement of the trough 430 when positioned within the bay 502. The bay 502 preferably has an indentation 506 at the end opposite the door 114, whereby the indentation 506 is designed to couple to the underside of the protrusion 602 on the corresponding end of the trough 430 in a snap-fit manner. The indentation 506 preferably restricts unwanted horizontal movement of the trough 430 within the bay 502. In another embodiment, the bay 502 includes alternate and/or additional mechanisms to inhibit undesired movement of the trough 430 within the bay 502. Alternatively, the appliance 100 does not include any mechanisms to inhibit horizontal movement of the trough 430 within the trough bay 502.

FIG. 7 is a cross-sectional view of the appliance 100, cut along the section line A-A in FIG. 1. The embodiment shown in FIG. 7 shows the lid 102 in the closed position relative to the base 104. The base 104 includes the thermal sealing mechanism 420 positioned in substantial vertical alignment with the sealing gasket 410 in the lid 102. As shown in FIG. 7, the trough 430 is positioned in the trough bay 502 such that the bottom portions 604 of the trough 430 are positioned below the retention protrusions 504 of the bay 502. The preferred embodiment also includes the power cord/battery compartment 204 and rotatably mounted cord retention flanges 206. FIG. 7 also depicts the roll of container material 424 stored within the compartment 422 of the appliance 100. FIG. 7 also illustrates the gaskets 406 of the primary evacuation chamber 408 and the trough 430 in contact with one another, defining the vacuum chamber 404 therebetween. Additionally, the 110, with cutting mechanism 412 in the lid 102, is in vertical alignment with the groove 428 in the base 104, thus allowing the cutting mechanism 412 to cut the container material when positioned above the groove 428.

The present device 100 allows the user to create a custom-made container or bag from the roll of container material 424. The operation is performed by the user first turning the rotary dial 304 to "Cut Only" to ensure that the sealing mechanism 420 and evacuation chamber 408 will not activated when the lid 102 is closed. In the preferred embodiment, the container material 424 is housed within the device 100, the user pulls on the roll 424 and dispenses an appropriate amount of container material. The user then preferably slides the blade handle 108 along the slot 110 to the opposing end of the lid 102, whereby the cutting mechanism 412 cuts the material 424 to provide the user with a separated piece of flexible material 424. It should be noted that the blade handle 108 is able to be moved in a direction from left to right as well as right to left along the slot 110 to cut the flexible material 424. Alternatively, the user does not dispense the flexible material 424 from the compartment 422 and/or does not cut the flexible material 424 using the cutting mechanism 412.

The user then opens the lid 102 and places an open end of the material 424 on top of the thermal sealing mechanism 420. The user then closes the lid 102 and turns the rotary dial 304 to the desired setting "1", "2", or "3". The user then preferably depresses the lid 102 downward momentarily to actuate the electro-mechanical switch 416 and thereby activate the device 100. The device 100 is then activated and performs the sealing process, whereby the thermal sealing mechanism 420 is energized and heats the flexible material 424 to the predetermined time associated with the setting. Once the sealing process is completed, the user is preferably notified by the indicator light 314 and is able to open the lid 102 to remove the flexible material bag 424. In one embodiment, the vacuum process occurs immediately before the sealing process is initiated. In another embodiment, the vacuum process does not occur, whereby only the sealing process occurs when the dial 302 is turned to setting "1", "2", or "3".

The present device 100 also allows the user to vacuum package an item placed within the container material 424. The operation is performed by the user first turning the rotary dial 304 to the desired setting of "1", "2", or "3". The user then opens the lid 102 and preferably places the open end of the container material 424 into the open end of the trough 430. The user then closes the lid 102. When the lid 102 is in the closed position, the gasket 406 surrounding the primary evacuation chamber 404 and the gasket 406 surrounding the trough 430 are in contact with each other. A substantially hermetic environment is able to be formed within the primary evacuation chamber 404 and the trough 430 when the vacuum process is performed. The user then preferably depresses the lid 102 downward momentarily to actuate the electro-mechanical switch 416 and thereby activate the device 100. In one embodiment, once the device 100 is activated, the vacuum source (not shown) draws air through the evacuation apertures 418 and pulls the side latch chambers 402 toward the base. This procedure seals the interior of the device 100 as well as seals the vacuum chamber 404 between the primary evacuation chamber 408 and the trough 430. The device 100 then performs the vacuum process, whereby air is drawn out of the vacuum chamber and the flexible container 424 through the evacuation port 408 for the amount of time associated with the setting of the rotary dial 304. Once the vacuum process is completed, the sealing process preferably begins, whereby the thermal sealing mechanism 420 is energized and heats the flexible material 424 to the predetermined time associated with the setting. Once the sealing process is completed, the user is preferably notified by the indicator light 314 and is able to open the lid 102 to remove the vacuum sealed bag 424.

Alternatively, after a predetermined time, vacuum to the primary evacuation chamber 404 is applied before the vacuum is cut off to the latch chambers 402. In an alternative embodiment, the vacuum applied to the latch chambers 402 is gradually reduced in a step down manner as the vacuum is gradually increased in the primary evacuation chamber 404. Evacuation of the primary evacuation chamber 404 and trough 430 is performed via the evacuation port 408. In an alternate embodiment, the vacuum source evacuates the latch chambers 402 for a fixed period of time. Additionally, in another alternative embodiment, the latch chambers are coupled to another vacuum source (not shown) independent from the vacuum source (not shown) associated with the primary evacuation chamber 408. In another alternative embodiment, each latch chamber 402 is associated with a corresponding independent vacuum source (not shown).

In another embodiment, the user is able to use the accessory port 312 (FIG. 3) to remotely seal a container using a vacuuming attachment (not shown). The user first couples a tube end of the vacuuming attachment (not shown) to the accessory port 312. The user also couples the other end of the vacuuming attachment to an appropriate container lid (not shown) which is preferably sealably coupled to a container (not shown). The user turns the rotary dial 304 to the "Accessory" setting. The user preferably closes the lid 102 and depresses the lid 102 downward momentarily to actuate the electro-mechanical switch 416 and thereby activate the device 100. Once activated, the vacuum source (not shown) draws air through the accessory port 312 and performs the vacuum process, whereby air is drawn out of the container for a predetermined amount of time or vacuum strength. Once the vacuuming process is completed, the user is preferably notified by the indicator light 314 and is able to remove the vacuuming attachment from the container lid. In one embodiment, the interior of the device 100 is sealed during the vacuuming process. In another embodiment, the interior of the device 100 is not sealed during the vacuuming process.

Figure 8:
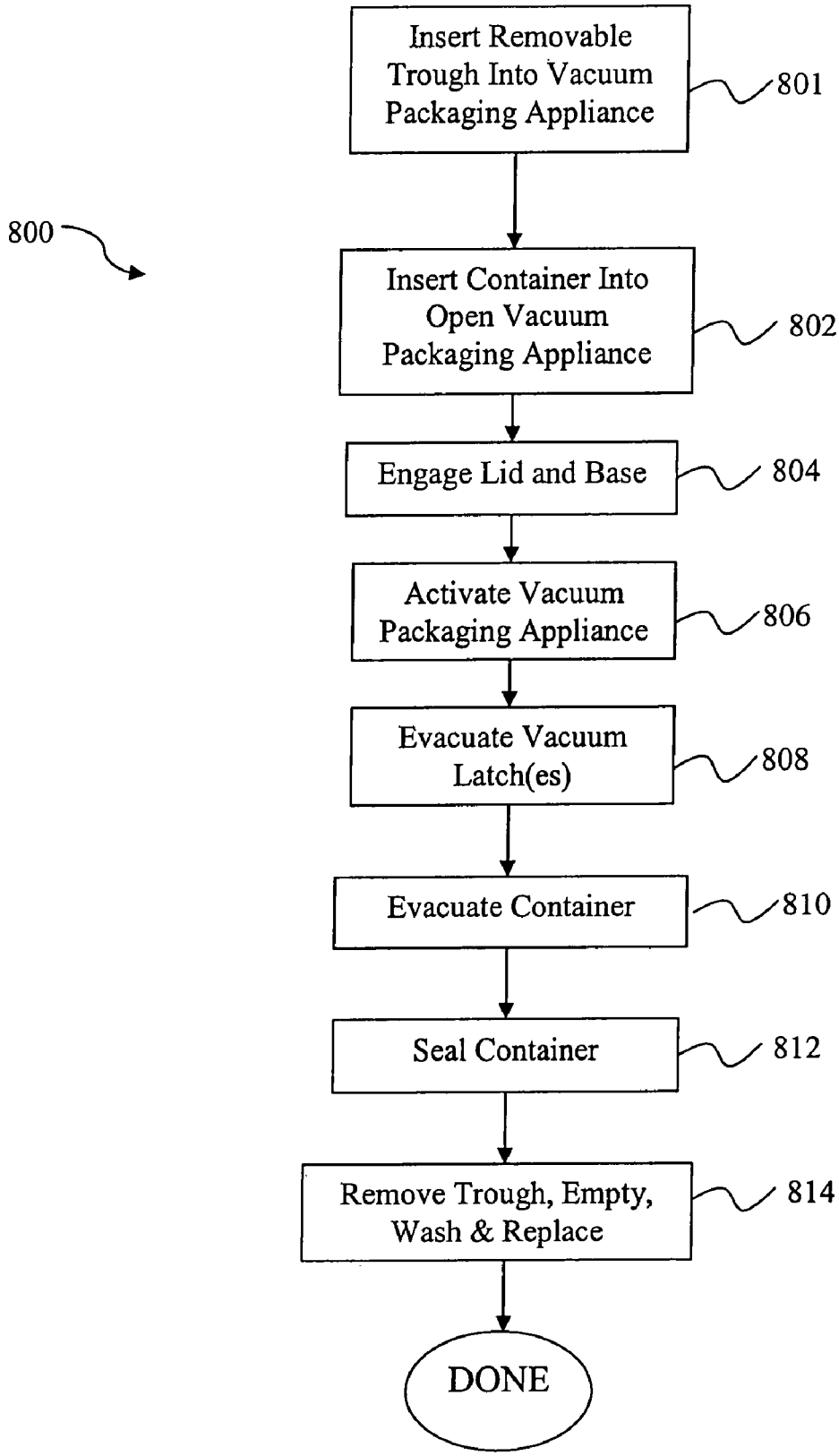
FIG. 8 is a flow chart illustrating a method of forming a hermetically sealed vacuum packaging container in accordance with one aspect of the present invention.

Turning next to FIG. 8, a method 800 of forming a hermetically sealed vacuum packaged container from an open container using a vacuum packaging appliance will now be described. As will be appreciated, the method of the present invention can be used with any suitable vacuum packaging appliance. Accordingly, flow reference numbering as used in the above FIGS. will not be used with reference to FIG. 8 unless merely for example.

In any event, the method 800 begins with required initialization steps. For example, a user may take packaging material and form seals on all but three sides. This could be done with use of the roll of bag material 424, or may be done by obtaining preformed bags. These are not specifically shown. In a step 801, the user inserts a removable trough into the vacuum packaging appliance. Actual implementation of this insert step 801 will depend upon the exact nature of the removable trough and the vacuum packaging device. For example, the user might be required to open a bay door, mate the coupling mechanism of the trough into the vacuum packaging device, and then snap or slid the removable trough into the vacuum packaging device, and then close the bay door.

In any event, in a step 802, the user inserts an open end of a container into the vacuum packaging appliance in order to begin forming a vacuum circuit with the vacuum packaging appliance. This may involve placing the open end into a drip trough, etc. In a next step 804, the operatively engages the lid and the base of the vacuum packaging appliance. As will be appreciated from the above discussion, engaging the lid and base closes the vacuum circuit formed by the container, the vacuum chamber(s) and the vacuum source. However, to provide a sufficient seal to evacuate the container via the vacuum circuit, a certain amount of pressure or force must be applied to maintain engagement of the lid with the base.

In a step 806, the user activates the vacuum packaging appliance. This activation 806 could be triggered by a variety of actions. For example, activation could be initiated by the user engaging the lid and the base. Alternatively, the user may first engage the lid and base, and then activate (through switch or button, etc.) the device. This activation may include one step for forming the vacuum latch, and then another for evacuation of the container.

In a step 808, a vacuum latch is formed between the lid and the base. The vacuum latch evacuation process could result in latch evacuation for a preset period of time, for a time as determined by the user, or until a certain sensed vacuum level is reached. As will be appreciated, using a process that evacuates the vacuum latch chambers described above would work well to form a vacuum latch between the lid and base. However, the present invention also contemplates other vacuum latch mechanisms. For example, a mechanical latch could be coupled to the vacuum circuit such that operation of the vacuum source causes the mechanical latch to provide the necessary tension of engagement between the lid and the base.

In a step 810, the container is evacuated in order to form a vacuum. Container evacuation can be accomplished through any suitable method as desired by the particular application. For example, the user may control container evacuation. Alternatively, container evacuation could begin automatically a set time period after latch evacuation or after the vacuum latch reaches a set vacuum level.

In a step 812, the container is sealed thereby forming a hermetically sealed vacuum packaging container. As will be appreciated, this sealing is often accomplished through a heat-sealing mechanism applied to the container. This heat-sealing mechanism can be engaged in any suitable manner; e.g., after a certain period of container evacuation or after a certain level of vacuum is reached within the container.

In a step 814, the user removes the removable tray, empties any captured contaminants, and then proceeds to wash the removable tray. Of course, the user may simply remove the tray, empty the tray out and reinsert this, only periodically or as necessary actually taking the extra effort to wash the tray. The present invention contemplates a tray that is suitable for machine washing, and with a gasket that must be removed prior to washing. However, a variety of different embodiments would be suitable.

It will be understood by those skilled in the art that the above-presented description is provided by way of example only and is not intended to be limiting in any way. Those skilled in the art will readily understand that numerous other embodiments of the invention are contemplated and possible which meet the scope and spirit of the invention.

What is claimed is:

1. An appliance for vacuum packaging a container comprising:

a base having a bottom surface connected to an upper surface by a sidewall, the base including a trough bay having a longitudinal axis, the sidewall including an opening in communication with the trough bay;

a lid coupled to the base and moveable between an open position and a closed position;

a trough being movable along the longitudinal axis of the trough bay in order to permit the trough to be inserted and removed from the trough bay through the sidewall opening;

the lid forming a vacuum chamber with the trough when the lid is in the closed position, wherein the vacuum chamber is adapted to receive an open end of the container therein; and a vacuum source coupled to the vacuum chamber and configured to remove air from the container.

2. The appliance as defined in claim 1 wherein the trough bay includes a longitudinally extending member which cooperates with the trough for guiding longitudinal movement of the trough in the trough bay.

3. The appliance according to claim 1 further comprising a sealing mechanism for thermally sealing the container for a selectable amount of time.

4. The appliance according to claim 1 wherein the trough further comprises a handle configured on an end proximal to the trough port.

5. An appliance for vacuum packaging a container comprising:

a base having a bottom surface supportable on a support surface and bounded by a sidewall extending upwardly from the bottom surface along a first axis;

a trough bay disposed in the base;

a lid coupled to the base and moveable between an open position and a closed position;

a trough removably disposed in the trough bay, the trough having a depth extending in the direction of the first axis, the trough being coupled to the trough bay upon sliding the trough in a direction generally perpendicular to the first axis, and wherein the trough is removable from the trough bay when the lid is in the closed position;

an evacuation chamber positioned in the lid and configured to form a vacuum chamber with the trough in the closed position, wherein the vacuum chamber is adapted to receive an open end of the container therein; and a vacuum source coupled to the evacuation chamber and configured to remove air from the container.

6. The appliance according to claim 5 wherein the trough bay is configured to restrict vertical movement of the trough therein.

7. The appliance according to claim 6 wherein the base further comprises a trough port in communication with the trough bay, wherein the trough is slidably coupled to the trough bay via the trough port.

8. The appliance according to claim 7 wherein the trough further comprises a handle configured on an end proximal to the trough port.

9. The appliance according to claim 5 further comprising a gasket coupled to a perimeter of the trough such that the gasket is positioned between the trough and the evacuation chamber in the closed position.

10. The appliance according to claim 5 further comprising a gasket coupled to a perimeter of the evacuation chamber such that the gasket is positioned between the trough and the evacuation chamber in the closed position.

11. The appliance according to claim 7 wherein the trough port further comprises a slidable door.

12. The appliance according to claim 5 wherein the trough bay includes a longitudinally extending protrusion engagable with a flange on the trough for guiding movement of the trough within the trough bay.

13. The appliance according to claim 5 wherein the trough bay has a longitudinal extent and the trough is movable into and out of the trough bay along the longitudinal extent of the trough bay.

14. The appliance according to claim 7 wherein the trough port further comprises an opening formed on a sidewall of the base.

* * * * *